United States Patent [19]

Strobel et al.

[11] 4,290,854

[45] Sep. 22, 1981

[54] METHOD OF OPERATING HORIZONTAL COKE OVEN BATTERIES

[75] Inventors: Manfred Strobel; Friedrich, both of Thiersch, Recklinghausen, Fed. Rep. of Germany

[73] Assignee: Firma Carl Still, Fed. Rep. of Germany

[21] Appl. No.: 103,232

[22] Filed: Dec. 13, 1979

Related U.S. Application Data

[60] Division of Ser. No. 967,612, Dec. 8, 1978, Pat. No. 4,256,540, which is a continuation-in-part of Ser. No. 853,817, Nov. 21, 1977, abandoned.

[30] Foreign Application Priority Data

Dec. 2, 1976 [DE] Fed. Rep. of Germany ..... 2654555

[51] Int. Cl.[3] ..... C10B 21/10

[52] U.S. Cl. ..... 201/26; 201/41

[58] Field of Search ..... 202/141, 143, 144, 146, 202/151, 111; 201/26, 41

[56] References Cited

U.S. PATENT DOCUMENTS

| | | | |
|---|---|---|---|
| 901,351 | 10/1908 | Koppers | 202/143 |
| 3,344,039 | 9/1967 | Nestler | 202/144 |
| 4,008,129 | 2/1977 | Strobel | 202/222 X |

*Primary Examiner*—Frank W. Lutter

*Assistant Examiner*—Roger F. Phillips

*Attorney, Agent, or Firm*—McGlew and Tuttle

[57] ABSTRACT

A horizontal coke oven battery construction in which a pusher is mounted to extend into the batteries from one side and push coke out of the batteries on the opposite side, comprises a plurality of coke oven batteries disposed in a row. A first waste gas flue extends along the pusher side of the batteries and a second waste gas flue extends along the coke side. A stack flue at one end of the batteries is connected to the first and second waste gas flues. The construction includes means for directing the heating gases into each oven battery during operation so that, in respect to the pusher and coke size, approximately one-half of the batteries is heated by upward burning and the other half is heated by downward burning. For example, all odd numbered batteries may be heated in the same direction and all even numbered batteries heated in the same direction. The invention also comprises a two-section regenerative heating system having reversing winches wherein the heating on one-half or approximately one-half of the oven chambers is equipped for upward burning and the heating of the other half is equipped with downward burning. Between the two halves, a center head maybe be provided, or only one reversing winch may be provided at the end of the battery.

1 Claim, 2 Drawing Figures

METHOD OF OPERATING HORIZONTAL COKE OVEN BATTERIES

This is a division of application Ser. No. 967,612 filed Dec. 8, 1978, now U.S. Pat. No. 4,256,540, which is a continuation of Ser. No. 853,817 filed Nov. 21, 1977, and now abandoned.

FIELD AND BACKGROUND OF THE INVENTION

This invention relates in general to coke ovens and, in particular, to a new and useful two-section regenerative heating system of horizontal coke oven batteries.

DESCRIPTION OF THE PRIOR ART

It is usual to provide two-section regenerative heating systems of coke oven batteries arranged in a row with equipment such that all of the batteries burn at the same time at one side upwardly and at the opposite side, downwardly. Time-staggering during the heating periods of the individual batteries is provided only insofar as the switching is timed consecutively, in order to avoid great pressure variations in the lines supplying the fuel gas.

In such a design, the combustion gases of all of the batteries must be evacuated at the same side in order to be conducted to the stack. If, for reasons of space, only one stack is provided for a plurality of batteries at one end of the row of batteries, and the waste gas-collecting flues and other lines for the waste gases must be connected to the stack, flue cross-sections are obtained, particularly near the stack, which are so large that their accommodation within the range of the batteries becomes difficult.

SUMMARY OF THE INVENTION

The present invention is directed to the elimination of the difficulties of the prior art by an appropriate design of a two-section regenerative heating system of coke oven batteries, particularly, such batteries in which the waste gases are evacuated through a common stack.

In accordance with the invention, the heating system is equipped in a manner such that at the same side, i.e., the pusher side or the coke side, one-half or approximately one-half of the number of batteries is heated by upward burning and, the other half of the batteries is heated by downward burning. With an even number of batteries, the heating will advantageously be divided exactly in half and with an odd number, the heating will be approximately in half. Thus, in accordance with the invention, within the same heating period and at the same side, for example, the odd-numbered batteries I, III, V, etc., of a row of batteries may be heated by upward burning, and the even-numbered batteries II, IV, VI, etc., by downward burning. Consequently, within any heating period, only one-half of the waste gases of the battery are to be conducted to the stack from one side (the pusher side or the coke side) and substantially smaller cross-sections can be provided for the waste gas-collecting flues and the other waste gas conduits to the stack, so that their disposition within the range of the coke oven batteries becomes much simpler.

In the following, the inventive manner of heating will be termed crosswise battery heating. The crosswise battery heating, however, is not only applicable to a plurality of batteries arranged in a row, but also to a single battery.

The dimensions of up-to-date horizontal regenerative coke oven chambers are, for example, 7 m in height, 17 m in length, and 0.45 m in width. The carbonization period is about 13 hours and the fuel consumption and amount of waste gases and, thereby, the cross-sections of the conduits and flues, are of such magnitude that in single batteries having, for example, 50 oven chambers, an accommodation in the bench passageways or in the area of the oven block is difficult. In accordance with the invention, here again, the cross-sections of the conduits can be reduced.

A single horizontal coke oven battery, bisectional as to its heating system and heatable crosswise, so that, for example, on one side, one-half or substantially one-half in number of the oven chambers is heated by upward burning while the other half is heated by downward burning is also as yet unknown. This also involves the particular problems of separating the two parts of the battery so as to prevent any leakage of heat, gas and air from one battery part to the other, and of dividing and designing the regenerators in the crossing area. The provision of a simple refractory wall in this area proved unsatisfactory.

Coke oven batteries are usually provided on their ends with battery heads comprising concrete walls to which the longitudinal anchor ties are also secured, and they further comprise thermally insulating brickwork. The thickness of such battery heads is considerable, for example, of about 2.0 m, and if an attempt is made to separate two parts of a battery by providing two heads therebetween, then, with the necessary passageway between the heads and their insulation, a building ground length of from 9 m to 10 m for oven chambers would be lost and, in most cases, this would be a prohibitive loss.

So-called center heads for coke oven batteries, comprising a double wall of steel concrete, which is parallel to the oven chambers and includes an intermediate space sub-divided into cells by crosswalls are also known. Such center heads occupy a substantially smaller width than two complete battery heads, i.e., including the insulating walls, their width may be only about 5.50 m. However, experience has shown that, in the long run, center heads designed in this manner are not capable of standing the heat influence. With the passage of time, their mechanical resistance is reduced and they no longer perform their function of providing a bonding support for the individual ovens of the battery. This fact clearly manifests itself as old coke oven batteries are being demolished.

A battery center head of the above mentioned kind is known from German Pat. No. 2,359,667, in which each cell is provided in its lower portion with one or more fresh air inlets and at its top portion width corresponding air outlets.

A battery center head designed in accordance with the above-noted patent has proven to be resistant even in long run of operation, and this was due to the good air cooling of its walls. The additional width occupied by such a center head, inclusive of the insulating walls, is about 4 m, which is justifiable in view of the purpose.

It has further been found that a center head for coke oven batteries in accordance with the aforementioned German Pat. No. 2,359,667 is particularly suitable when it is provided between two battery parts which are heated crosswise, and that at this location, the head performs its function of preventing a heat transfer and a leakage of the heating media from one part of the battery to the other particularly well, and that at this location, it is also capable of withstanding the heat influence of the two parts of the battery in permanent operation.

The two adjacent regenerators are designed as half-regenerators in the crossing area, in a manner known per se, in order to ensure a supply of preheated heating media, lean gas and air, to the heating walls at both sides of the separating wall. Up to date, the regenerators at the end heads of the batteries have been designed in a similar manner.

It was not certain whether a modern coke oven battery with its large size oven chambers, divided in this manner, would have satisfactory stability. This has, however, been proven in practice. The inventive design is much simpler than the design with two complete battery heads and, as compared to the prior art design, considerable quantities of building material are saved.

In a coke oven battery of the prior art having 50 oven chambers of 7.00 m in height, 17.00 m in length, and 0.45 m in width and having a carbonization time of 13 hours for normal caking coal, the known design results in a cross-section of 3.75 $m^2$, i.e., inside width of 2.2 m, for the lean gas conduits to be placed in the bench passageways, and in a cross-section of 15 $m^2$, i.e., about $4\times4$ m, for the waste gas collecting flues. In accordance with the invention, the heating system of the coke oven battery is divided into two parts, each covering 25 coke oven chambers and, between these parts, a center head is provided, in accordance with German Pat. No. 2,359,667. In the inventive design, the cross-section required at either side is only 1.88 $m^2$ for the lean gas conduits, i.e., an inside width of about 1.55 m, and only 7.5 $m^2$ for the waste gas collecting flues, i.e., about $2.75\times2.75$ m of inside clearance. The resulting overall length of the battery is 81.5 m. In the design with two prior art center heads, the battery would be longer by 5 m.

The two parts of the coke oven battery separated by the center head may each be equipped with a reversing winch for opening and closing the gas and air supply passages as well as the waste gas flues. However, it is advantageous to provide a single reversing winch for both halves of the battery, with the winch installed at one end of the battery and connected by means of a linkage in a manner such that, for example, in one-half of the battery, the cocks or valves are opened, while in the other half of the battery, the corresponding cock and valves are closed.

Accordingly, it is an object of the invention to provide a two-section regenerative heating system for horizontal coke oven batteries which include a plurality of batteries disposed in a row and waste gas collecting flues connected to each other disposed on respective pusher and coke sides of the batteries, wherein, one-half or approximately one-half of the number of batteries is heated by upward burning and the other half is heated by downward burning.

Another object of the invention is to provide a two-section regenerative heating system of a horizontal coke oven battery having reversing winches, wherein, on the same side, the heating of one-half or approximately one-half of the number of oven chambers is equipped for upward burning and the heating of the other half is equipped for downward burning.

A further object of the invention is to provide a horizontal coke oven battery construction which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENT

Figure 1:
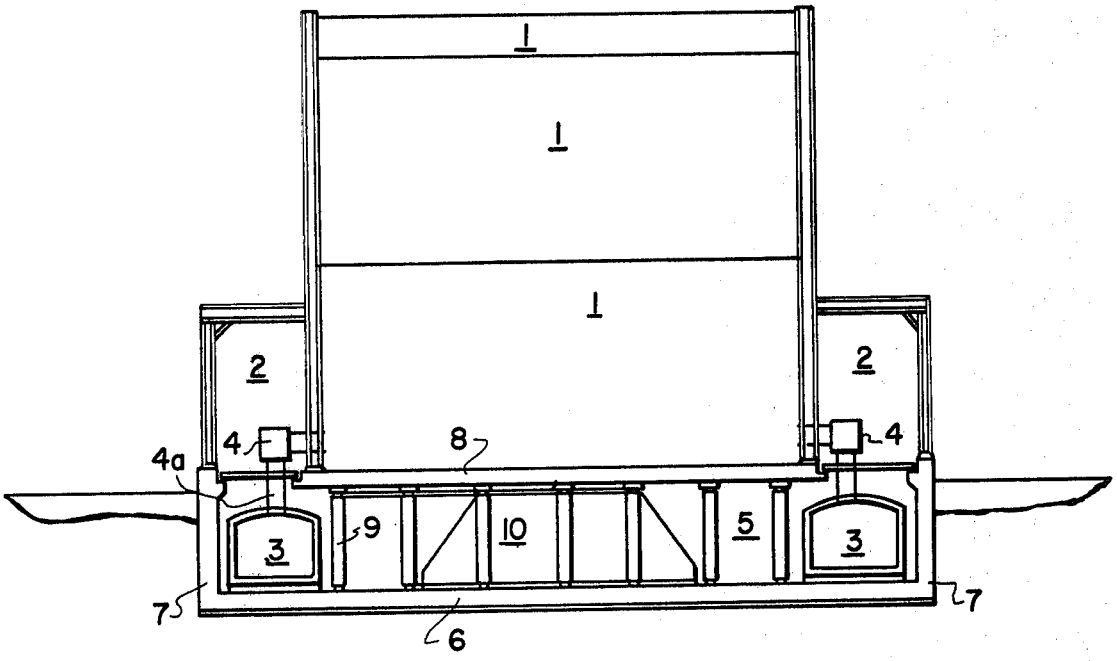
FIG. 1 is a schematic side elevational view of a coke oven battery constructed in accordance with the invention.

Referring to the drawings in particular, the invention embodied therein, comprises an underjet coke oven battery which is itself heated crosswise and which is constructed in accordance with the invention.

Figure 2:
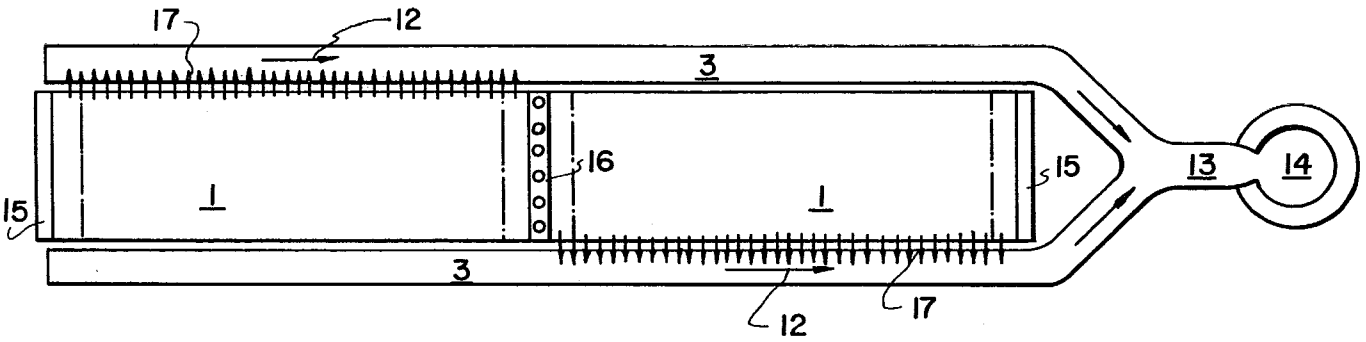
FIG. 2 is a top plan view of the coke oven battery shown in FIG. 1.

FIGS. 1 and 2 show the oven block 1 with regenerators, oven chambers, heating walls, and the roof of the battery, the bench passageways 2P and 2C, the waste heat flues 3P and 3C, waste heat valves 4 with connections **4*a* to the waste heat flues, the so-called nozzle basement 5 with concrete supports 9 between the foundation plate 6 and the basement roof 8, corner supporting walls 7, fixed-point and swing walls 10, and the floor level 11 of the coke plant. Bench passage 2P and flue 3P are shown on a pusher side of oven block 1 with 2C and 3C** on a coke side thereof.

FIG. 2 shows the waste gas flues 3P and 3C at the pusher and coke sides, the stack flue 13, the stack 14, the end heads 15 of the battery, and the center head 16 separating the two parts of the battery. The arrows 17 indicate that at the lefthand side 1 of center head 16, the pusher side 1 burns downwardly, and at the righthand side of the center head, the coke side burns downwardly, further that the waste heat gases pass through waste heat valves 4 and connections **4*a* into the respective waste gas flues 3P and 3C (FIG. 1) and from there, in the direction of arrows 12, to stack flue 13 and stack 14. The total cross-sectional area of flue 3P and 3C together are approximately equal to the cross-sectional area of the stack flue 13, and the cross-sectional area of flue 3P is approximately equal to that of flue 3C**.

While a specific embodiment of the invention has been shown and described in detail to illustrate the application of the principles of the invention, it will be understood that the invention may be embodied otherwise without departing from such principles.

What is claimed is:

1. A method of operating a horizontal coke oven battery having a pusher side and a coke side with a plurality of coke ovens disposed in a row with a first waste gas flue extending along the pusher side and a second waste gas flue extending along the battery side, the coke oven battery having a center head in approximately the longitudinal middle of said row of coke ovens, the coke oven battery having a stack flue connected to said first and second waste gas flues, the cross-sectional area of said first waste gas flue being approximately equal to that of said second waste gas flue in the area of said stack flue, said stack flue having a cross-sectional area equal to the sum of the cross-sectional area of said first and second waste gas flues; the method comprising the steps of directing heating gases into approximately one half of the coke ovens in the coke oven battery for heating the coke oven by an upward gas flow, directng heating gases into the remaining coke ovens for heating the coke ovens by a downward gas flow, collecting the gases to be exhausted from said approximately one-half of said coke oven gases in one of said first and second waste flues to form approximately one half of the total gas flow to said stack flue, collecting waste gases from the remainder of said coke ovens in the other of said first and second waste gas flues, the coke ovens on one side of said center head being heated by said upward gas flow and the coke ovens on the other side of said center head being heated by said downward gas flow, the final total gas flow supplied in said first waste gas flue in the area of said stack flue being equal to the final total gas flow supplied in said second waste gas flue in the area of said stack flue, said stack flue having a gas flow supplied thereto of approximately twice that of said first and second waste gas flues.

* * * * *